US005174116A

United States Patent [19]

Ishikawa

[11] Patent Number: 5,174,116

[45] Date of Patent: Dec. 29, 1992

[54] DISPLACER-TYPE STIRLING ENGINE

[75] Inventor: Hiroki Ishikawa, Chiryu, Japan

[73] Assignee: Aisin Seiki Kabushiki Kaisha, Kariya, Japan

[21] Appl. No.: 857,501

[22] Filed: Mar. 25, 1992

[30] Foreign Application Priority Data

Mar. 26, 1991 [JP] Japan ..... 3-84449

[51] Int. Cl.[5] ..... F02G 1/043

[52] U.S. Cl. ..... 60/520

[58] Field of Search ..... 60/517, 520

[56] References Cited

U.S. PATENT DOCUMENTS 3,937,018 2/1976 Beale .
4,404,802 9/1983 Beale .
4,412,418 11/1983 Beale .
4,471,626 9/1984 Sarcia ..... 60/520 X
4,567,726 2/1986 Vitale et al. ..... 60/520
4,708,725 11/1987 Okumura ..... 60/520 X

*Primary Examiner*—Allen M. Ostrager
*Attorney, Agent, or Firm*—Burns, Doane, Swecker & Mathis

[57] ABSTRACT

A displacer-type Stirling engine includes buffer space provided in back of a power piston, and a front chamber in which a small-diameter piston provided on an end of a displacer rod is reciprocated. The buffer space and the front chamber are communicated by a conduit so that a fluctuation in pressure which develops in the buffer space is used as an auxiliary power source for driving the displacer rod.

4 Claims, 2 Drawing Sheets

DISPLACER-TYPE STIRLING ENGINE

BACKGROUND OF THE INVENTION

1. Field of the Invention

This invention relates to a displacer-type Stirling engine such as a free-piston Stirling generator, a compressor, a pump or an engine, in which a displacer is driven by a motor.

2. Description of the Prior Art

A Stirling engine is known in which a cam is driven by a motor, a displacer piston is reciprocated by the cam via a displacer rod, and a free power piston is reciprocated by the displacer piston. A method of reducing motor power in an engine of this type has been proposed by the applicant but has not yet been disclosed publicly. In the proposed method, mechanical springs or gas-operated springs, or a combination thereof, are disposed above and below the cam to construct an oscillatory system in which the differential between the fluctuating pressure in a working space and the static pressure in a crank chamber is used as an external force to act upon the displacer rod.

With this method, the force which acts upon the displacer rod owing to the fluctuating pressure of the working gas and the static pressure of the crank chamber is utilized effectively as auxiliary power. An additional aim is to reduce loss attributed to surface pressure caused by inertial force. Since springs are installed that are capable of reducing motor driving power when the displacer piston is reciprocated, a high torque is needed in order to compress the springs at starting of the motor. Though net efficiency is raised, a problem encountered is that the motor must be large in size. This runs counter to a reduction in the size of the apparatus.

SUMMARY OF THE INVENTION

Accordingly, an object of the present invention is to provide a displacer-type Stirling engine in which the torque required at motor start-up is reduced and the motor is made small is size.

According to the present invention, the foregoing object is attained by providing a displacer-type Stirling engine having a displacer piston reciprocated by a displacer rod reciprocated, without the aid of springs, by a motor via a cam, and a free power piston reciprocated by the displacer piston via a working gas, characterized in that a buffer space at a back surface of the power piston and a front chamber through which a small-diameter piston provided on an end portion of the displacer rod is reciprocated are communicated by a conduit, and fluctuating pressure generated in the buffer space is used as an auxiliary power source for driving the displacer rod.

In operation, the fluctuating pressure produced in the buffer space is very small in comparison with that in the working space. However, the fluctuating pressure in the buffer space, which is at the back face of the power piston, is introduced to the front chamber through which a small-diameter piston provided on an end portion of the displacer rod is reciprocated, and this fluctuating pressure is used as as an auxiliary power source for driving the displacer rod. Thus, the engine is not furnished with a spring mechanism for driving the displacer rod. As a result, a large motor for producing a high torque is unnecessary and the size of the motor can be reduced. This contributes to a reduction in the size cf the overall apparatus.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

A preferred embodiment of a displacer-type Stirling engine will now be described in detail with reference to the drawings.

Figure 1:
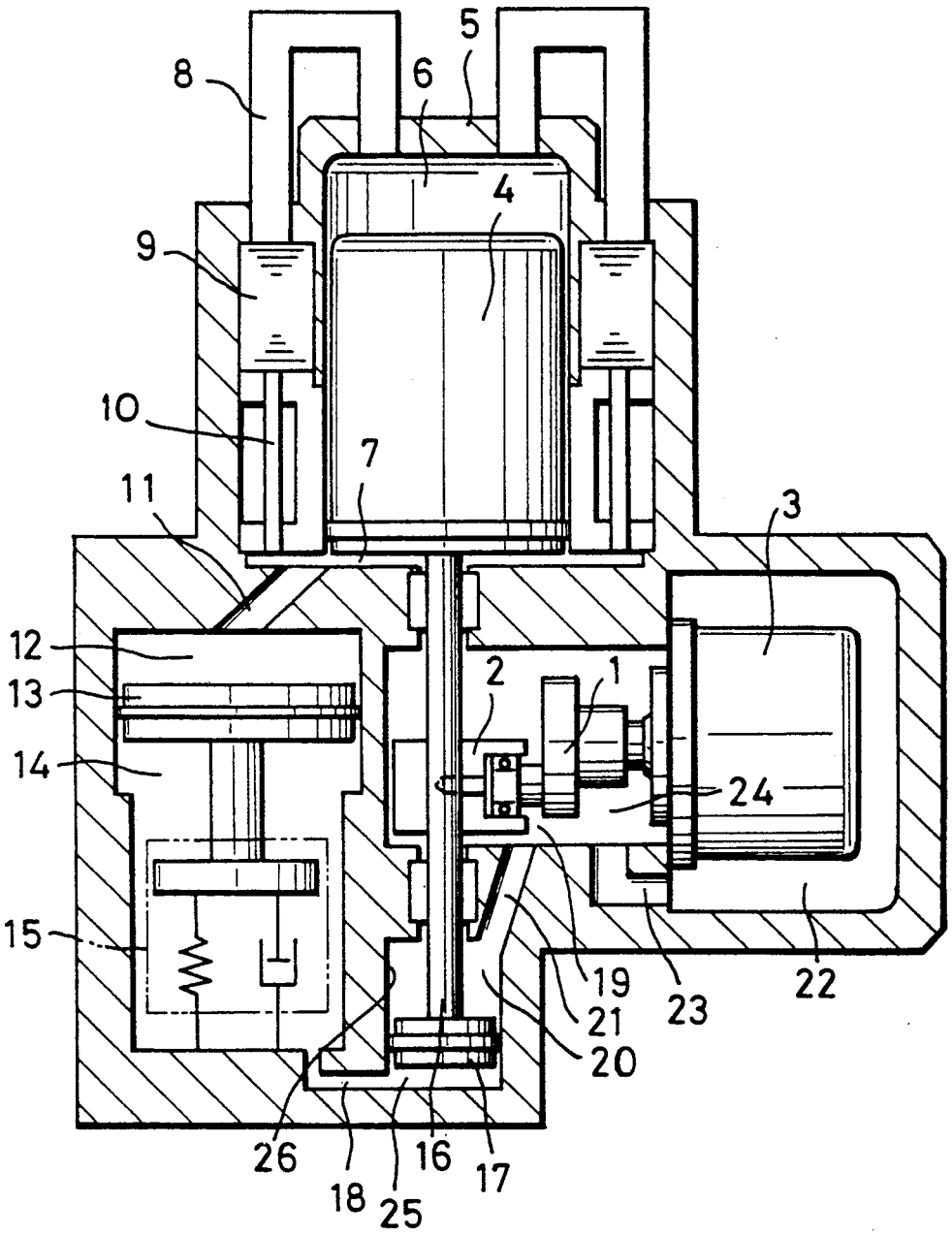
FIG. 1 is a diagram showing the construction of a displacer-type Stirling engine according to the present invention.

FIG. 1 illustrates an embodiment of a displacer-type Stirling engine according to the present invention. The Stirling engine includes a displacer piston 4 driven reciprocatively by a motor 3 via a crank 1 and a yoke cam 2. Owing to the reciprocation of the displacer piston 4, a working gas such as helium or hydrogen sealed within the casing 5 moves between an expansion chamber 6 and a first compression chamber 7 through a heater 8, a regenerator 9 and a cooler 10. A pressure wave produced at this time is introduced to a second compression chamber 12 using a first conduit 11, whereby a power piston 13 is reciprocated with a suitable phase delay (the optimum value of which is in the vicinity of 90°) relative to the motion of the displacer piston 4.

A first buffer space 14 is formed in back of the power piston 13, i.e., on the side of the power piston that is opposite the second compression chamber 12. Disposed within the first buffer space 14 is a load 15, such as a linear generator, compressor or pump having a spring function, connected to the power piston 13. An output is extracted from the load.

The first buffer space 14 is connected to a front chamber 25 by a second conduit 18 so that a pressure fluctuation within the first buffer space 14, which fluctuation is unwillingly produced from the reduction in the size of the apparatus, is introduced to the front chamber 25 and used as auxiliary power for driving the motor 3. The motor 3 is disposed within a motor chamber 22.

Figure 2:
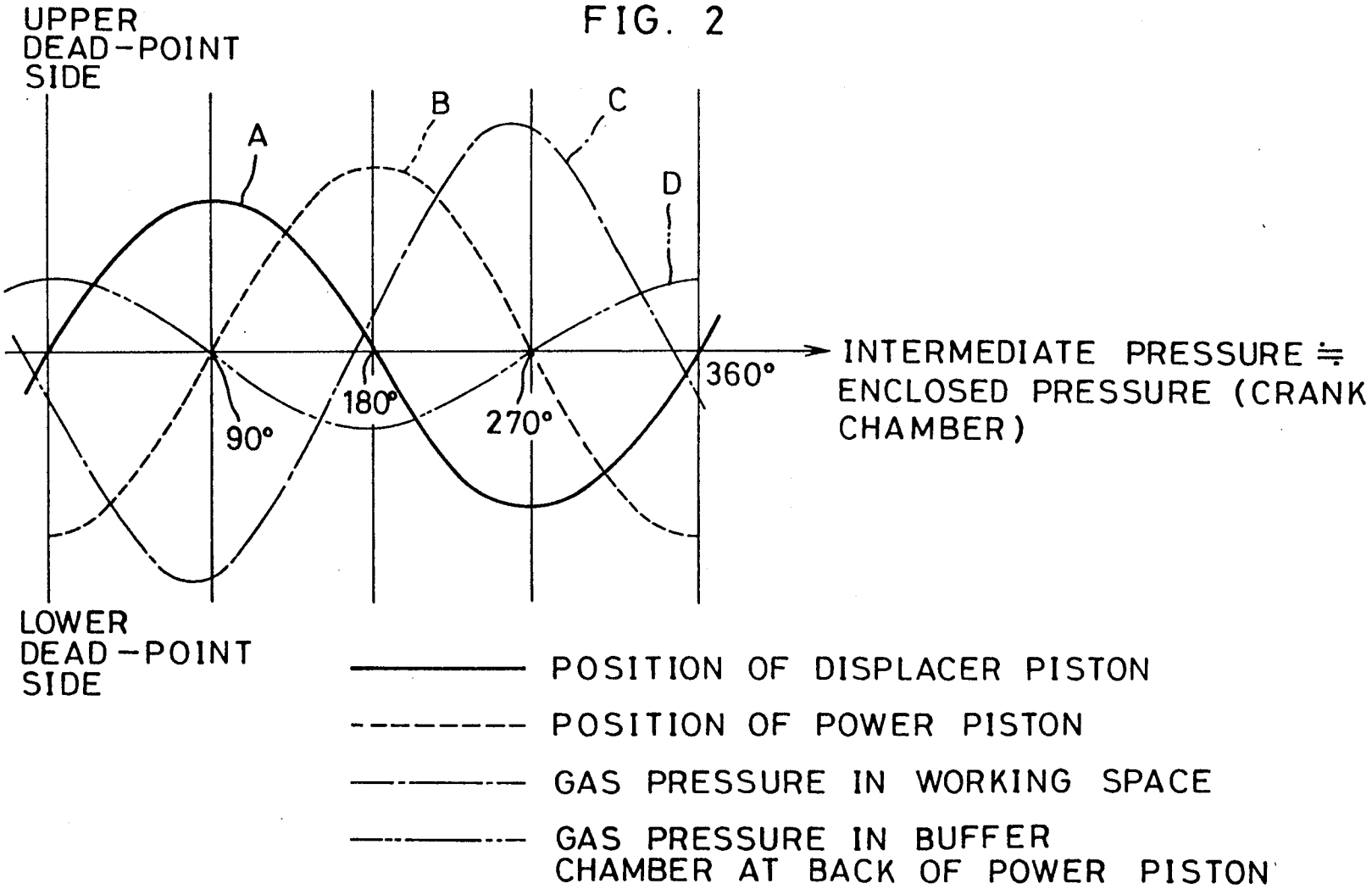
FIG. 2 is a diagram showing the relationship between piston position and gas pressure at various portions.

A small-diameter piston 17 is disposed at the lower end of the displacer rod 16 connected to the displacer 4, i.e., at the end of the displacer rod 16 that is opposite the displacer piston 4. The piston 17 is reciprocated within a small cylinder 26. Pressure introduced through the second conduit 18 acts upon an end face of the small-diameter piston 17. It should be noted that the displacer rod 16 and displacer piston 4 are not provided with a spring mechanism such as a gas spring or mechanical spring acting as means for producing a driving force. By introducing the fluctuation in pressure within the first buffer space 14 to the end face of the small-diameter piston 17, this pressure can be utilized as auxiliary power at all times with respect to the motion of the displacer piston 4, as illustrated in FIG. 2. A curve A indicated by the solid line in FIG. 2 illustrates a change in the position of the displacer piston 4, a curve B indicated by the dashed line illustrates a change in the position of the power piston 13, a curve C indicated by a one-dot chain line illustrates a change in gas pressure within the working space, and a curve D indicated by a two-dot chain line illustrates a change in pressure within the first buffer space 14.

A crank chamber 19 accommodating the crank 1 and yoke cam 2 and a back chamber 20 of the small-diameter piston 17 are communicated by a first communicating passage 21, whereby the gas in the back chamber 20 is not compressed and a gas spring is not formed. Accordingly, a high torque is not required when the motor is started, and the auxiliary power can be utilized so that the motor can be reduced in size.

The crank chamber 19 and the motor chamber 22 form a single second buffer space 24 using a second communicating passage 23.

Thus, in accordance with the present invention, an improvement in net efficiency and a reduction in the size of the motor can be achieved at the same time. Since the Stirling engine need not be furnished with a spring mechanism, it is possible to reduce space in comparison with the prior art. Furthermore, the compressing work of the buffer space in back of the power piston can be recovered as power for driving the displacer piston, thereby raising efficiency.

As many apparently widely different embodiments of the present invention can be made without departing from the spirit and scope thereof, it is to be understood that the invention is not limited to the specific embodiments thereof except as defined in the appended claims.

What is claimed is:

1. A displacer-type Stirling engine comprising:

a motor;

a displacer rod reciprocated by said motor;

a displacer piston reciprocated by said displacer rod;

a free power piston reciprocated by a change in a working pas pressure due to a movement of said displacer, said free power piston defining a first buffer space at a back surface thereof;

a second piston provided on an end of said displacer rod so as to be reciprocated thereby, said second piston having a diameter smaller than that of said displacer piston;

a front chamber in which said second piston is reciprocated; and a conduit communicating said first buffer space and said front chamber;

a fluctuation in pressure which is produced in said buffer space being used as an auxiliary power source for driving said displacer rod.

2. The displacer-type Stirling engine according claim 1 wherein a load is disposed within said first buffer space.

3. The displacer-type Stirling engine according to claim 2 wherein said displacer rod is connected springlesely to said motor via a cam which is housed in a crank chamber and a back chamber is communicated to said crank chamber so as to define a second buffer chamber.

4. The displacer-type Stirling engine according to claim 3 wherein a first compression chamber defined by said displacer is communicated through a conduit to a second compression chamber defined by said free power piston.

* * * * *